US008070003B2

(12) United States Patent
True et al.

(10) Patent No.: US 8,070,003 B2
(45) Date of Patent: Dec. 6, 2011

(54) PACKAGE FEATURE

(75) Inventors: B. Todd True, Maplewood, NJ (US); David Hu, South Plainfield, NJ (US)

(73) Assignee: Johnson & Johnson Consumer Companies, Inc., Skillman, NJ (US)

( * ) Notice: Subject to any disclaimer, the term of this patent is extended or adjusted under 35 U.S.C. 154(b) by 177 days.

(21) Appl. No.: 12/538,191

(22) Filed: Aug. 10, 2009

(65) Prior Publication Data

US 2010/0270258 A1 Oct. 28, 2010

Related U.S. Application Data

(60) Provisional application No. 61/173,187, filed on Apr. 27, 2009.

(51) Int. Cl.
*B65D 1/02* (2006.01)

(52) U.S. Cl. ..... 215/382; 215/379; 215/384; 215/381; 215/383; 220/669; 220/675; 220/672

(58) Field of Classification Search ..... 215/382, 215/379, 384, 381, 383; 220/669, 675, 672
See application file for complete search history.

(56) References Cited

U.S. PATENT DOCUMENTS

| | | | | |
|---|---|---|---|---|
| 1,835,252 | A * | 12/1931 | West | |
| D244,176 | S | 5/1977 | Pardo | |
| D273,940 | S | 5/1984 | Soos et al. | |
| D304,550 | S | 11/1989 | Demarest | |
| D305,301 | S | 1/1990 | Gutkowski | |
| D343,358 | S | 1/1994 | Lay et al. | |
| D347,389 | S | 5/1994 | Crawford | |
| D349,058 | S | 7/1994 | Farce | |
| D352,458 | S | 11/1994 | Gray | |
| 5,385,250 | A * | 1/1995 | Pasquale | 215/374 |
| D363,225 | S | 10/1995 | Kudo | |
| D363,431 | S | 10/1995 | Mansau | |
| D382,803 | S | 8/1997 | Gavin | |
| D398,238 | S | 9/1998 | Bertolini et al. | |
| D415,031 | S | 10/1999 | Mahlmann | |
| 6,012,601 | A * | 1/2000 | Van Dam | 220/667 |
| D424,944 | S | 5/2000 | Mohary et al. | |
| D429,645 | S | 8/2000 | Erckelbout et al. | |
| D447,953 | S | 9/2001 | Brynestad et al. | |
| D461,718 | S | 8/2002 | Brozell | |
| D484,418 | S | 12/2003 | Diete | |

(Continued)

FOREIGN PATENT DOCUMENTS

AT 293908 B * 10/1971

(Continued)

*Primary Examiner* — Anthony Stashick
*Assistant Examiner* — Cynthia Collado
(74) *Attorney, Agent, or Firm* — Karen G. Horowitz

(57) ABSTRACT

Formation of an "organically"-shaped feature on an otherwise abstract-shaped package. In particular, an organic or human anatomical feature is provided on an otherwise inanimate shape. More particularly, a package, such as a bottle, having a non-representational form (in other words, a package not shaped to resemble any particular form existing in nature) is provided with a feature specifically designed to resemble a form in nature or "organic" form. In an exemplary embodiment, the form in nature (or "organic" feature) is a "baby fat crease." In particular, a crease is provided on the package to mimic the look of a baby fat crease. The geometry of the crease as well as the geometry of the package are optimized to achieve the desired organic look or effect.

20 Claims, 4 Drawing Sheets

U.S. PATENT DOCUMENTS

| | | | | |
|---|---|---|---|---|
| 6,814,248 | B2 * | 11/2004 | Beck et al. | 215/384 |
| D506,390 | S | 6/2005 | Bakic | |
| D510,029 | S | 9/2005 | Marcot | |
| 7,044,325 | B2 * | 5/2006 | Przytulla et al. | 220/672 |
| D527,640 | S | 9/2006 | Cummings et al. | |
| D533,074 | S | 12/2006 | Mongeon et al. | |
| D537,342 | S | 2/2007 | Smith et al. | |
| D543,115 | S | 5/2007 | Flurer et al. | |
| D545,198 | S * | 6/2007 | Hatcher et al. | D9/516 |
| D558,576 | S | 1/2008 | Zigmans | |
| D574,246 | S | 8/2008 | Russell et al. | |
| D576,038 | S | 9/2008 | Mazurkiewicz et al. | |
| D576,489 | S | 9/2008 | Mazurkiewicz et al. | |
| 2002/0104820 | A1 * | 8/2002 | Hong et al. | |
| 2003/0015491 | A1 * | 1/2003 | Melrose et al. | |
| 2007/0199916 | A1 * | 8/2007 | Denner et al. | |

FOREIGN PATENT DOCUMENTS

| | | | |
|---|---|---|---|
| DE | 1432147 | * | 2/1969 |
| GB | 2331069 | * | 5/1999 |
| KR | 3020070046371 | * | 11/2007 |
| KR | 300487471 | | 4/2008 |
| RU | 000239637-0002 | * | 10/2004 |
| WO | 0189938 | * | 11/2001 |
| WO | 2005067419 | * | 7/2005 |
| WO | 2007025251 | * | 3/2007 |
| WO | 2007050330 | * | 5/2007 |

* cited by examiner

PACKAGE FEATURE

CROSS-REFERENCE TO RELATED APPLICATION

The present application claims the benefit of the earlier filing date of U.S. provisional application No. 61/173,187, filed Apr. 27, 2009, which application is incorporated by reference herein in its entirety; the present application also claims the benefit of the earlier filing date and is a continuation-in-part of U.S. design patent application No. 29/336,043, filed Apr. 27, 2009, which design application is hereby incorporated by reference herein in its entirety.

FIELD OF THE INVENTION

The present invention relates to formation of a feature on a package to achieve a desired effect or look. More particularly, the present invention relates to forming on a package an organic-shaped feature to impart to the package a look suggestive of but not fully representative of an organic shape.

BACKGROUND OF THE INVENTION

Packages shaped to resemble a form existing in nature are known in the packaging art. For example, maple leaf shaped bottles have been used for maple syrup, bear or bee hive shaped containers or bottles have been used for honey, and even human shapes have been used for containers or bottles (such as the bottle for Mrs. Butterworth's syrup sold by Pinnacle Foods Group LLC). Sections of pre-existing naturally occurring forms also have been applied to otherwise non-specific or abstract or non-representational or geometrical packaging shapes. For instance, honey bottles have been formed with multiple grooves on their sides to create a form on the package reminiscent of a bee hive without having the entire package be in the form of a beehive. Containers for fragrances or cosmetics or beauty products have been formed with a portion of a floral object such as a flower or even a leaf Human forms have also been replicated on packaging or other abstract forms. For instance, a nose shape has been provided on otherwise abstract or inanimate forms such as a ceramic tissue box holder.

SUMMARY OF THE INVENTION

In accordance with the principles of the present invention, an isolated organic feature is provided on a package that is not otherwise shaped as or to represent a specific organic form. The organic feature conveys or suggests an organic feel to the package without directly or explicitly forming the package in a readily identifiable organic or animate form.

More particularly, an isolated organic feature, such as a contour or segment or isolated portion of the human anatomy (e.g., a human body part) is provided on a package to impart the package with a particular organic "feel" or visual impression. In an exemplary embodiment formed in accordance with the basic principles of the present invention, an organic feature resembling a baby fat crease (a crease or fold between rolls of chubby flesh or skin in the baby's skin) is provided in a section of the package surface. It is preferable that the package itself has an organic, albeit abstract, form, such as a softly contoured rather than angular shape. As such, the organic feature is provided in an abstractly organic environment to achieve an overall visual impression that suggests the context for such organic feature without directly or expressly representing the context for such feature.

The present invention distinguishes over prior art packages in that the overall shape and configuration of the package remains an essentially inanimate or abstract form that alone is not suggestive a particular organic feature. The organic feature is sufficiently isolated so that an explicit complete organic or animate form is merely suggested but not fully represented. For instance, only a baby fat crease is provided, rather than an entire arm or leg with a baby fat crease therein. Similarly, a knuckle could be formed without the finger or toe on which it would be seen. As such, the package form is reminiscent or suggestive of an organic or animate form in nature without fully taking on such organic or animate form. Thus, in the case of a baby fat crease as the organic feature, although the crease in the package is formed to resemble an organically-shaped crease, the remaining shape and contour of the package preferably is not also an animate or anatomical form (e.g., is not an arm or leg on which a baby fat crease is often seen).

In one embodiment, the shape and contour of the surfaces of the package surrounding the inventive feature are selected to enhance the organic feel of the feature. For instance, the package may be selected to have an organic form or to be biomorphic, such irregular forms or contours or shapes based on natural forms or contours or shapes. Typically, softly curved contours are associated with organic forms, and enhance the organic visual impression to be conveyed by the organic feature formed in accordance with the principles of the present invention.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
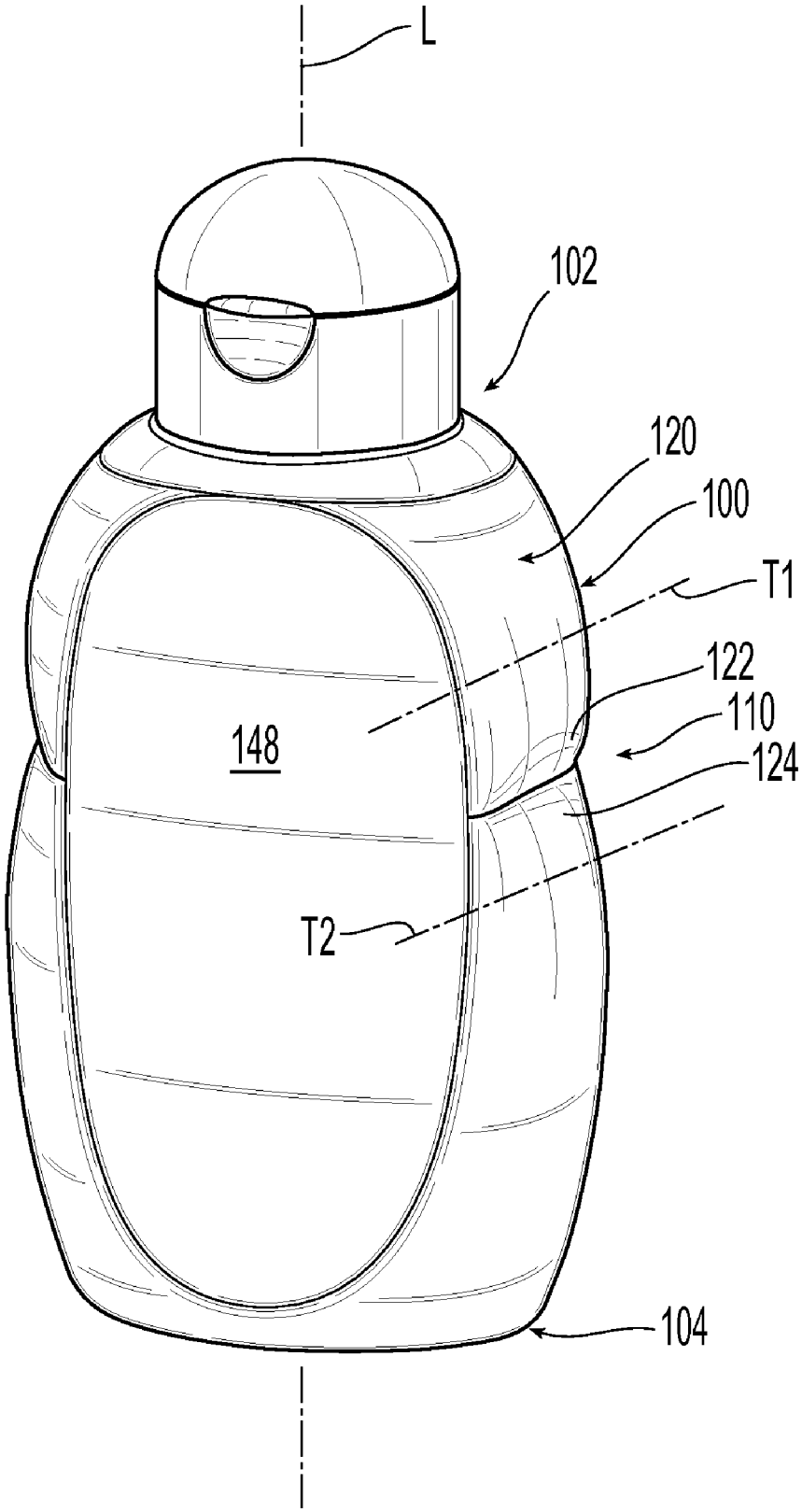
FIG. 1 is a perspective view of an exemplary container embodying the principles of the present invention.

In accordance with the principles of the present invention, an isolated organically-shaped feature is provided on a package that preferably is not otherwise formed in an explicit organic shape such that the organic feature conveys an abstract visual impression of a particular organic feature. The base shape of the package (in other words, the overall shape of the package unaffected by the organically-shaped feature) may have an abstract organic form, such as a softly curved or contoured shape, but is not a readily identifiable explicit or specific organic form. The organically-shaped feature need not be sufficiently detailed to portray a specific organic feature directly or explicitly. Rather, the organically-shaped feature may be an isolated aspect of an organic feature, or an organic feature that is not automatically recognizable out of context or in isolation. Preferably, the organically-shaped feature is a feature of the human anatomy, such as an anatomical shape (e.g., a knuckle or knee) or a feature of an anatomical part (e.g., a nostril rather than the entire nose). In the exemplary embodiment of FIGS. 1-4, the organically-shaped feature is an extractable element meant to be a representation of a baby fat crease such as commonly seen on a baby's arm or leg. The package on which such organically-shaped feature may be provided may be a container for a particular product associated with such organically-shaped feature, such as a bottle. In the case of the organically-shaped feature being in the form of a baby fat crease, the package may be a bottle for a baby product, such as a lotion, cream, oil, powder, ointment, wash, or shampoo.

As used herein, the term "crease" means a line impressed or indented into a surface, such as formed by folding the surface about such line to result in the indentation of such line in the surface. The term "organic" is to be understood herein as an image or form that resembles, suggests, or shows a relationship to a naturally-occurring, as opposed to man-made, structure, object, or form, or a natural growing or expanding process. A "non-representational" form or shape is to be understood herein as a form or shape that bears little or no resemblance or does not refer to anything outside itself or recognizable forms within the natural world, but, instead, presents only the visual elements of line, shape, color, form, and texture, etc. An "abstract" form or shape is to be understood herein as a form or shape that does not have a readily recognizable subject, and does not attempt to represent objects in a realistic or figurative manner, but, instead, may simplify and/or stylize an object to accentuate certain qualities or content. An "organic abstraction" as used herein refers to the use of irregular shapes, or shapes based on natural forms or patterns, generally characterized by curving, biomorphic edges, in contrast with geometric or angular shapes.

It is understood that a baby fat crease has rolls of skin and fat or flesh above and below the crease so that a package imitating such form should have convexly-curved walls above and below the crease that is to resemble the baby fat crease. The present invention optimizes geometries of a package to suggest along a portion or surface area thereof an organic form. The geometry of the surfaces of the package as well as of the crease itself, the extent of the crease and its relation with the curved surfaces, and other features of a package are selected in accordance with the principles of the present invention to cause the crease to resemble an organic feature. It will be appreciated that one or more of the parameters described herein have been determined (either individually or in combination) to result in the formation of a feature having a resemblance to a particular organic feature. In the exemplary embodiment, the organic feature is a crease resembling the crease or fold in a baby's skin typically known as a baby fat crease.

Figure 2:
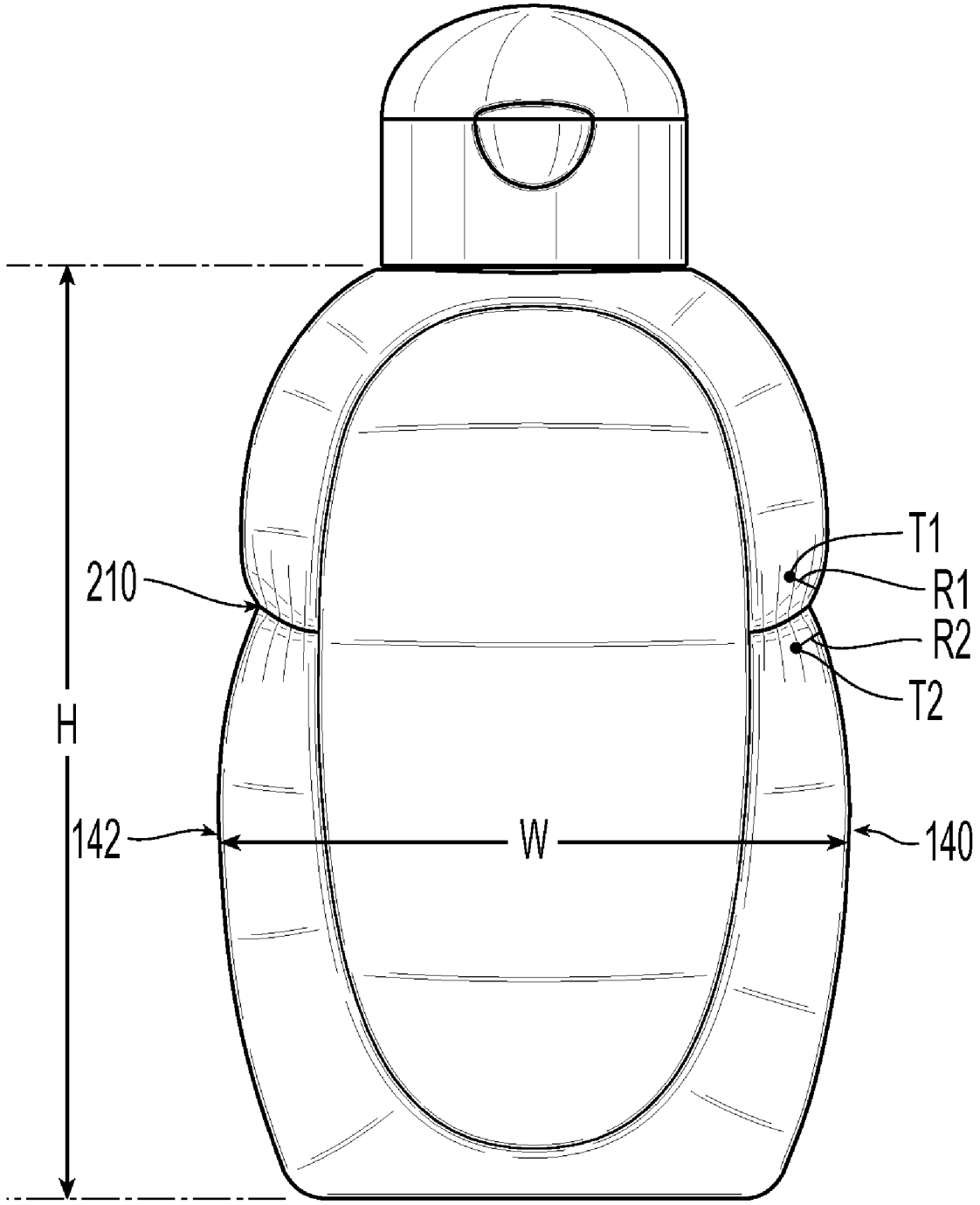
FIG. 2 is a front elevational view of the container of FIG. 1.
Figure 3:
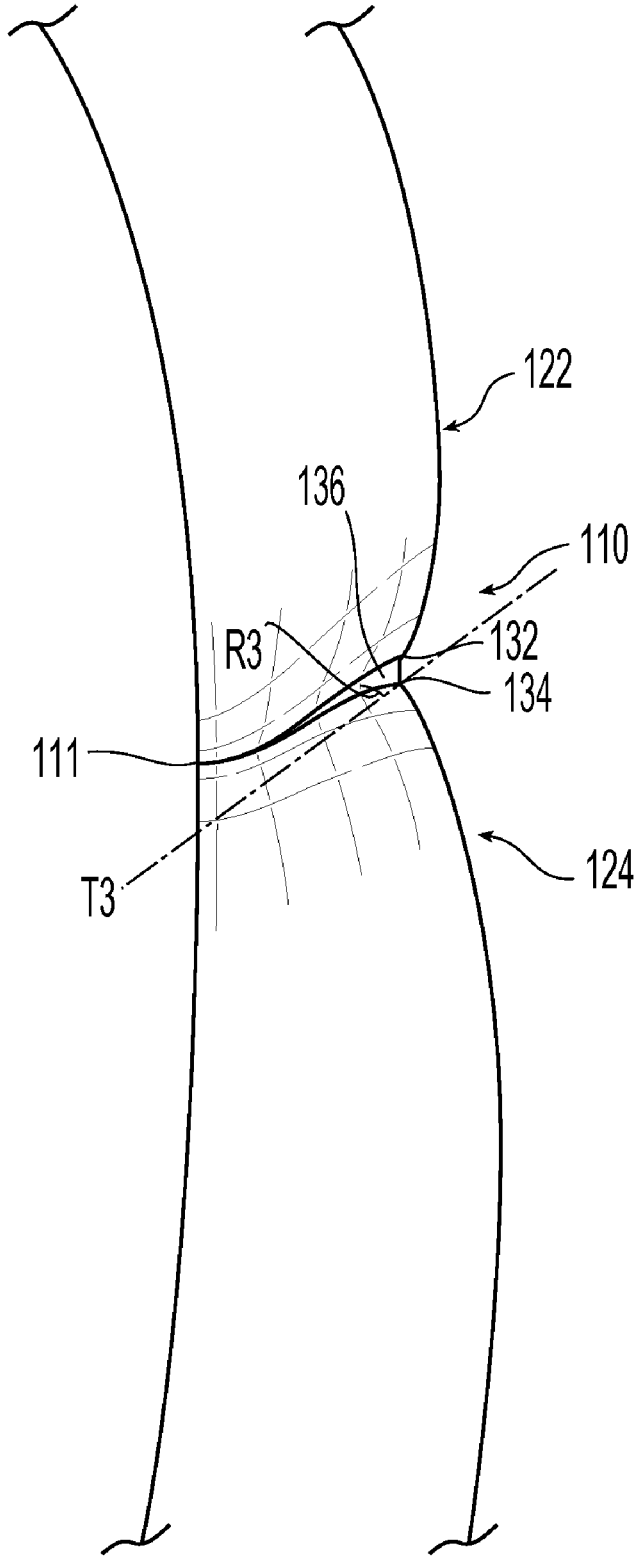
FIG. 3 is an enlarged detail of an inventive feature illustrated in FIG. 1.
Figure 4:
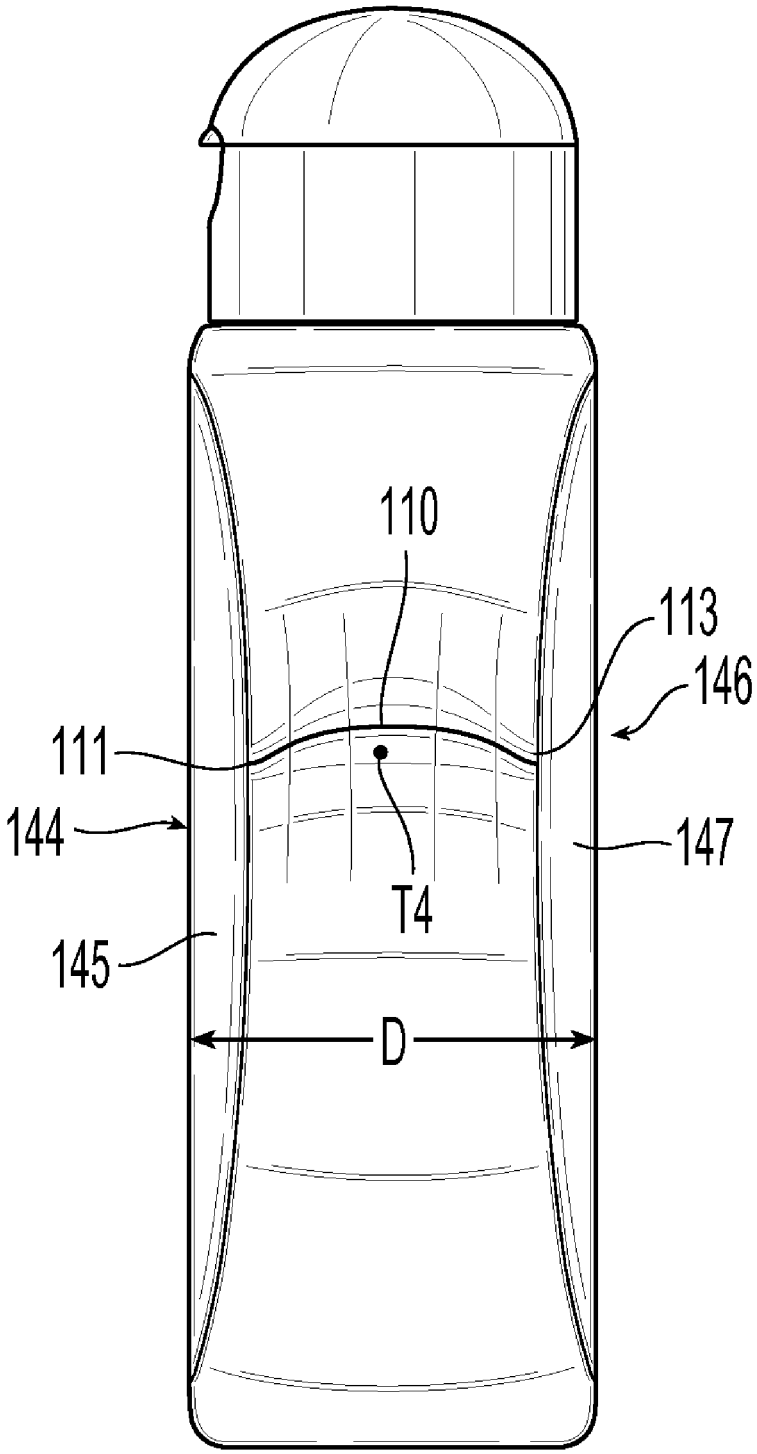
FIG. 4 is a side elevational view of the container of FIG. 1.

The exemplary embodiment of FIGS. 1-4 illustrates a package in the form of a bottle 100 not having a particular explicit or specific organic form, on which an organically-shaped feature 110 in the form of a "crease" is provided to convey a visual impression of a baby fat crease in bottle 100. It will be appreciated that other forms of packages may be formed in accordance with the principles of the present invention to have an organically-shaped feature, and other organically-shaped features besides a baby fat crease may be formed within the scope of the present invention. Organically-shaped feature 110 may be described with reference to a wall section of bottle 100 along which organically-shaped feature 110 is provided. In accordance with one aspect of the present invention, organically-shaped feature 110 may be defined with respect to contours of a longitudinal wall section 120 on which organically-shaped feature 110 is provided, such longitudinal wall section 120 extending along longitudinal axis L from a top 102 to a bottom 104 of bottle 100. For purposes of describing the features of the present invention, "top" is understood herein as the top of the portion of the package intended to contain another element, and not including other portions of the package serving other or additional functions, such as a neck finish which is considered to extend above the top of the bottle, or a dispensing element such as a spout, or another feature not generally considered part of the main body of the package. It will be appreciated that although a flip-top closure is illustrated in FIGS. 1, 2, and 4, any type of closure or dispensing element (such as a pump) may be provided on bottle 100 without affecting the scope of the present invention.

In the exemplary embodiment of FIGS. 1-4, longitudinal wall section 120 has a first convexly-curved upper section 122 above organically-shaped feature 110, and a second convexly-curved lower section 124 below organically-shaped feature 110. First convexly-curved section 122 and second convexly-curved section 124 may be said to approach and fold into organically-shaped feature 110 provided therebetween. First convexly-curved section 122 is convexly curved about a first transverse axis T1 transverse to longitudinal axis L and second convexly-curved section 124 is convexly curved about a second transverse axis T2 transverse to longitudinal axis L. First and second transverse axes T1 and T2 may be parallel to each other to achieve the desired effect to be described in further detail below. However, deviations from parallel are within the scope of the present invention if the desired organic visual impression or effect (to be described in further detail below) is achieved nonetheless. In particular, it may be desirable (such as to achieve a more organic effect) for first convexly-curved section 122 and second convexly-curved section 124 to curve about transverse axes T1 and T2 that are not parallel. Additionally, or alternatively, first convexly-curved section 122 and second convexly-curved section 124 may be formed as complex convexly-curved surfaces having varying radii of curvature about respective transverse axes T1 and T2, and/or curving about an axis in addition to respective transverse axes T1 or T2. It will be appreciated that although transverse axes T1 and T2 are transverse to longitudinal axis L, the planes in which either or both of transverse axes T1 and T2 lie and the plane in which longitudinal axis L lies may or may not be coplanar without detracting from the effect of the convex curvature of first convexly-curved section 122 and second convexly-curved section 124.

Organically-shaped feature 110 in the exemplary embodiment of FIGS. 1-4 is in the form of a surface section of bottle 100 resembling a crease, particularly a baby fat crease. Because baby fat creases are formed between rolls of pudgy or fleshy baby fat, first convexly-curved section 122 and second convexly-curved section 124 preferably are convexly-curved in a manner that mimics the curvature of the pudgy flesh above and below a baby fat crease. Moreover, organically-shaped feature 110 preferably is contoured to mimic the manner in which skin or flesh folds inwardly to form a baby fat crease. The relative curvatures of first convexly-curved section 122, second convexly-curved section 124, and organically-shaped feature 110 contribute to the effect of the combination of first convexly-curved section 122, second convexly-curved section 124, and organically-shaped feature 110 to resemble a baby fat crease. The respective angular extents of at least first convexly-curved section 122 and second convexly-curved section 124, and/or the placement of organically-shaped feature 110 also may contribute to the effect of combination of first convexly-curved section 122, second convexly-curved section 124, and organically-shaped feature 110 to resemble a baby fat crease.

First convexly-curved section 122 has a first radius of curvature R1 and second convexly-curved section 124 has a second radius of curvature R2 (FIG. 2), with radii of curvature R1 and R2 preferably being selected so that first convexly-curved section 122 and second convexly-curved section 124 have an appropriate curvature along a given longitudinal extent along height H of bottle 100 (the vertical dimension from bottom 104 to top 102) for mimicking rolls of pudgy flesh. For a given longitudinal extent, if either radius of curvature R1 or R2 is too small, then the resulting surface curvature would be too extreme to represent baby flesh, but would more likely represent pinched flesh or a roll of skin without baby fat below it. And, if either of radius of curvature R1 or R2 is too large for a given longitudinal extent, then the resulting surface curvature would be too gradual to represent baby flesh, and would more likely represent flesh above and below a crease or wrinkle in a juvenile's or adult's skin. First radius of curvature R1 may be the same as or different from second radius of curvature R2. A broad range of radii of curvature R1, R2 may be selected to achieve the desired organic effect, which may also be dictated by the curvature of organically-shaped feature 110, as will be described in further detail below. It will be appreciated that the curvature of either first convexly-curved section 122 or second convexly-curved sections 124 need not be constant, such that neither R1 nor R2 is constant. However, any changes in the radii of curvature of either first convexly-curved section 122 or second convexly-curved section 124 preferably do not result in discontinuities or edges (at which a tangent cannot be drawn) which would not resemble rolls of flesh or pudgy skin surrounding a baby fat crease. Preferably, any undulations that would cause organically-shaped feature 110 to not be a primary feature are avoided.

As described above, organically-shaped feature 110 achieves the form of a baby fat crease at least partially because of the relative curvatures of first convexly-curved section 122, second convexly-curved section 124, and organically-shaped feature 110. In particular, the contrast in the convex curvatures of first convexly-curved section 122 and second convexly-curved section 124 with respect to the curvature of organically-shaped feature 110 is at least partially responsible for the organic look and feel or overall visual impression of such region, resulting in a form resembling a baby fat crease. As may be appreciated with reference to the enlarged detailed view of organically-shaped feature 110 illustrated in FIG. 3, the intersection of the two convex surfaces of first convexly-curved section 122 and second convexly-curved section 124 preferably includes a first point of inflection 132 at the transition from first convexly-curved section 122 to organically-shaped feature 110 and a second point of inflection 134 at the transition from organically-shaped feature 110 to second convexly-curved section 124. A concavely-curved surface 136 is formed between first convexly-curved section 122 and second convexly-curved section 124. The complex contour or curvature created by first convexly-curved section 122, concavely-curved section 136, and second convexly-curved section 124 is intended to resemble the folds of skin surrounding and forming a baby fat crease. To achieve such visual impression, the curvatures of each of first convexly-curved section 122, concavely-curved section 136, and second convexly-curved section 124 are selected to mimic the complex curves of a section of a baby's skin having a baby fat crease, and to model the manner in which the continuous surface of a baby's skin folds in on itself at a baby fat crease. Organically-shaped feature 110 thus is formed without sharp angles or discontinuities to resemble an organic intersection of two complex curved segments of an organic surface such as skin, intersecting in a crease or fold commonly known as a baby fat crease. It will be appreciated that not only does a blend of radii to achieve a gradual or gentle change in curvature achieve an organic visual impression, but such gradual or gentle change in curvature also is beneficial in terms of manufacturing considerations. In particular, a bottle formed in accordance with the principles of the present invention may be formed by a molding process. As known to those of ordinary skill in the molding art, it is desirable to reduce, if not eliminate, sharp edges in molds which could create quality issues such as thin spots in the molded part or nicks on the molded part or in the mold itself.

In order to convey the visual impression of an organic feature such as a baby fat crease, radius of curvature R3 of concavely-curved surface 136 preferably is sufficiently small enough for the visual impression conveyed by such curvature to be a fold or crease rather than a more gradual change in contour (such as a wavy contour). More particularly, radius of curvature R3 of concavely-curved surface 136 of organically-shaped feature 110 may be limited not to exceed approximately 10 mm, more preferably no more than 5 mm, and most preferably no more than 2 mm. Of course, such radii of curvature are selected for a typical bottle height for a consumer product, which is generally less than approximately 30 cm. Thus, an optimal radius of curvature R3 may be said to be preferably no more than approximately 3.5%, and more preferably no more than approximately 1.5%, and most preferably no more than approximately 0.5% of the overall height H of the bottle on which organically-shaped feature 110 is to be provided.

Another manner in which radius of curvature R3 of concavely-curved surface 136 may be defined to convey the visual impression of an organic feature such as a baby fat crease is to select a radius of curvature R3 that is dramatically proportionately smaller than first radius of curvature R1 of first convexly-curved section 122 and second radius of curvature R2 of second convexly-curved section 124. More particularly, radius of curvature R3 of concavely-curved surface 136 about a third transverse axis T3 transverse to longitudinal axis L (and either parallel to or transverse to either of transverse axes T1 and T2) preferably is sufficiently small relative to first radius of curvature R1 and second radius of curvature R2 such that to an eye of an ordinary observer the concave curvature of concavely-curved section 136 is overshadowed by the convex curvature of first convexly-curved section 122 and second convexly-curved section 124 to the extent that such concave curvature is not noticed as a curvature in the bottle surface, but instead, conveys the visual impression of a crease or fold in an otherwise continuous surface in longitudinal wall section 120 formed by first convexly-curved section 122 and second convexly-curved section 124. Stated another way, a sufficiently dramatic change in radius of curvature from first convexly-curved section 122 to concavely-curved section 136 and/or from second convexly-curved section 124 to concavely-curved section 136 allows for concavely-curved section 136 to appear to have sufficient depth to resemble a fold or crease like a baby fat crease rather than a mere change in contour such as a wavy surface. For example, a decrease in radius of curvature of more than approximately 60% (the proportionate or relative decrease from one of radii of curvature R1, R2 to radius of curvature R3), and more preferably more than approximately 75%, and most preferably more than approximately 80% results in a sufficient contrast in curvatures to resemble a fold of an organic material such as baby skin with baby fat underneath. In the case of first convexly-curved section 122 and/or second convexly-curved section 124 having a varying radius of curvature, it will be appreciated that the radius of curvature of the region of first convexly-curved section 122 and second convexly-curved section 124 adjacent or joining organically-shaped feature 110 is the radius of curvature having the greatest affect on organically-shaped feature 110 resembling a baby fat crease. Preferably, radii of curvature R1 and R2 remain substantially constant along a minimum angular extent of at least approximately 10 degrees about transverse axes T1 and T2, and preferably approximately 35-40 degrees about transverse axes T1 and T2.

The environment of longitudinal wall section 120 in which organically-shaped feature 110 is provided preferably also maintains the organic visual impression conveyed by longitudinal wall section 120 and particularly organically-shaped feature 110. Because organic elements generally have some degree of curvature, some degree of convex curvature is necessary for the surfaces laterally adjacent longitudinal wall section 120 in order to maintain an organic visual impression. In addition to curving about axes transverse to longitudinal axis L, at least one and preferably both of first convexly-curved section 122 and second convexly-curved section 124 are also convexly-curved about longitudinal axis L. Such curvature also contributes to the organic effect of the surfaces which provide the environment for organically-shaped feature 110, thereby enhancing the organic effect of organically-shaped feature 110. The radius of curvature of first convexly-curved section 122 and second convexly-curved section 124 about longitudinal axis L preferably is substantially constant along a minimum angular extent of at least approximately 10 degrees about longitudinal axis L, and preferably approximately 35-40 degrees about longitudinal axis L. Preferably, the curvature of either of first convexly-curved section 122 and second convexly-curved section 124 about longitudinal axis L is selected in view of the overall proportions, particularly in cross-section, of bottle 100. Preferably, the ratio of a width W (a distance between a first side wall 140, in which organically-shaped feature 110 is formed, and second side wall 142, as may be seen in FIG. 2) to a depth D (a distance between front wall 144 and back wall 146, as may be seen in FIG. 4) at a given height along overall height of bottle 100 preferably is at least approximately 1.3:1, and at most approximately 2.5:1. A smaller ratio of width to height will result in a cross-section too close to circular to convey a natural organic look of a baby's limb on which a baby fat crease may be seen, and a larger ratio of width to height will result in a cross-section that is too elongated so that front and back walls 144, 146 appear almost flat and thus not sufficiently organic in nature to convey the curvature of a baby's limb on which a baby fat crease may be seen. As may be appreciated, the body part on which a baby fat crease generally appears has a gently curved convex curvature about an axis transverse to the direction in which the baby fat crease extends (e.g., along the length of the limb on which the baby fat crease appears). Thus, curvature of first convexly-curved section 122 and second convexly-curved section 124 about longitudinal axis L may further contribute to organically-shaped feature 110 having the appearance of a baby fat crease. As will be appreciated, preferably there are no discontinuities or edges (at which a tangent cannot be drawn) formed by the convex curvature of either of first convexly-curved section 122 and second convexly-curved section 124 about longitudinal axis L which cause such section not to resemble a roll of flesh or pudgy skin surrounding a baby fat crease.

Similarly, concavely-curved surface 136 (between first convexly-curved section 122 and second convexly-curved section 124), forming the crease portion of the baby fat crease look of organically-shaped feature 110, preferably also is convexly curved about longitudinal axis L of bottle 100. The angular extent of concavely-curved surface 136 about longitudinal axis L preferably is selected to mimic the typical extent of a baby fat crease around the baby's limb. Although baby fat creases can extend around a baby's entire wrist, typically a baby fat crease is more limited in its angular extent. The angular extent of concavely-curved surface 136 about longitudinal axis L preferably is not greater than approximately 180 degrees, although a full 360 degrees about longitudinal axis L may be desirable in order to resemble a baby fat crease fully encircling a baby's wrist, for example. Of course, other modifications to the surface of bottle 100 may offset a greater than 180 degree angular extent of concavely-curved surface 136, such as the presence of an additional concave surface somewhere along the extent of concavely-curved surface 136 about longitudinal axis L. It will be appreciated that if the angular extent of concavely-curved surface 136 about longitudinal axis L is too short, then concavely-curved surface 136 would have the appearance of a damaged area rather than an intended surface feature. For instance, concavely-curved surface 136 preferably is visible from a side view of concavely-curved surface 136 and/or longitudinal wall section 120 in which it is formed. More particularly, if a front view of concavely-curved surface 136 is considered a vantage point at which a lateral midpoint of concavely-curved surface 136 is at 0 degrees, then a side view of concavely-curved surface 136 is a view at which concavely-curved surface 136 is rotated approximately 90 degrees away from such front view. Preferably, concavely-curved surface 136 is noticeable from such side view.

The relative longitudinal extents of first convexly-curved section 122 and second convexly-curved section 124 also may be selected to optimize the visual impression of organically-shaped feature 110 as a baby fat crease. In other words, the longitudinal placement of organically-shaped feature 110 along the longitudinal extent of longitudinal wall section 120 (in the direction of longitudinal axis L) also affects the resulting visual impression of organically-shaped feature 110 as a baby fat crease. Placement of organically-shaped feature 110 at a midpoint along longitudinal axis L results in a symmetry that is not common in organic forms. More importantly, baby fat creases typically do not occur at an exact midpoint along a baby's limb. Accordingly, it is preferable that organically-shaped feature 110 is placed offset from the longitudinal midpoint along longitudinal axis L, although an organically-shaped feature 110 at or slightly below the midpoint can still convey a look of a baby fat crease. Of course, it will also be appreciated that if organically-shaped feature 110 is placed too close to top 102 of bottle 100, an insufficient amount of first convexly-curved section 122 remains to convey the visual impression of pudgy flesh above organically-shaped feature 110. Likewise, if organically-shaped feature 110 is placed too close to bottom 104 of bottle 100, an insufficient amount of second convexly-curved section 124 remains to convey the visual impression of pudgy flesh below organically-shaped feature 110. Organically-shaped feature 110 is positioned at a longitudinal position above bottle bottom 104 that preferably is more than approximately 4/10 and less than approximately 8/10 the overall height H (the vertical dimension from bottom 104 to top 102) of bottle 100 height H of bottle 100. Most preferably, organically-shaped feature 110 is positioned within approximately the middle 7/10 of bottle 100.

The radius of curvature R3 of concavely-curved section 136 preferably varies along the extent of organically-shaped feature 110 so that organically-shaped feature 110 has a defined first end 111 and a corresponding defined second end 113 as illustrated in FIG. 4. As may be appreciated with reference to the enlarged detail view of FIG. 3, radius of curvature R3 varies along the extent of organically-shaped feature 110 and increases towards either end 111 or 113 so that the "crease" of organically-shaped feature 110 appears to have a beginning and an end. Moreover, the longitudinal extent of concavely-curved surface 136 decreases towards either end 111 or 113 of organically-shaped feature 110. The resulting effect is that the crease shape of organically-shaped feature 110 fades in and fades out similar to the manner in which a baby fat crease fades in and out, or gradually fades or transitions into the baby's smooth skin. The curvature of first convexly-curved section 122 above organically-shaped feature 110 and second convexly-curved section 124 below the organically-shaped feature 110 also changes. Specifically, to have organically-shaped feature fade at either end in the manner a baby fat crease fades away at either end, not only does the radius of curvature R3 of concavely-curved section 136 have to increase, but also the radius of curvature of the walls sections above and below the crease have to increase and shift to join one another in a substantially smoothly curved surface having no area at which a tangent cannot be drawn.

Although organically-shaped feature 110 of the present invention may extend in a relatively confined horizontal region of bottle 100 (such that organically-shaped feature 110 extends substantially perpendicular to longitudinal axis L), it has been discovered that a degree of curvature of organically-shaped feature 110 away from a confined horizontal region is desirable to achieve a more natural or organic effect or look. In particular, just as a baby fat crease does not extend along a simple straight line, it is preferable that an organically-shaped feature 110 formed in accordance with the principles of the present invention to resemble a baby fat crease does not extend along a completely straight horizontal line (perpendicular to longitudinal axis L) either. In the exemplary embodiment of FIGS. 1-4, concavely-curved section 136 preferably is curved about a fourth transverse axis T4 (see FIG. 4) transverse to longitudinal axis L as well as transverse axis T3 (about which concavely-curved surface 136 concavely curves). As may be appreciated with reference to the exemplary embodiment of FIGS. 1-4, in which organically-shaped feature 110 extends along a curve rather than a straight horizontal line, such curvature enhances the organic or specifically anatomical feel of organically-shaped feature 110. With reference to the above-described optimal location of organically-shaped feature 110 along height H of bottle 100, the position of a curved organically-shaped feature 100 along height H of bottle 100 preferably is measured from the highest point of organically-shaped feature 100.

It will be appreciated that in order to impart the look of a baby fat crease, preferably no more than three, and more preferably no more than two organically-shaped features 110 are provided along a longitudinal extent of bottle from top to bottom. In other words, preferably no more than two, and preferably no more than one organically-shaped feature 110 may be found above or below a given organically-shaped feature 110. In the exemplary embodiment of FIGS. 1-4, preferably no more than two organically-shaped features 110 are provided in a given longitudinal wall section 120. More particularly, only a single crease is provided in a given longitudinal wall section 120 in the exemplary embodiment of FIGS. 1-4. Although a second or third crease may be provided in a given longitudinal wall section 120, it will be appreciated that multiple creases will detract from the visual effect of a baby fat crease because a baby's limbs typically are not so long as to accommodate more than two or three baby fat creases. If multiple creases shaped to resemble baby fat creases are provided in a given longitudinal wall section 120, such creases preferably are not at identical longitudinal distances from one another.

In accordance with one aspect of the present invention, although more than longitudinal section of bottle 100 may be provided with at least one crease (such as organically-shaped feature 210 on a side 142 of bottle 100 essentially diametrically opposed to side 140 on which longitudinal wall section 120, along which organically-shaped feature 110 is formed, is provided), preferably no other type of organically-shaped form is provided on bottle 100. For instance, in the exemplary embodiment of FIGS. 1-4, in which organically-shaped feature 110 is in the form of a baby fat crease, preferably the remaining surface area of bottle 100 does not have sections shaped to resemble other organic forms, particularly organic forms anatomically related to a baby fat crease (such as a limb on which a baby fat crease may be found). As such, bottle 100 retains an essentially non-representational form, and organically-shaped feature 110 may be said to be an organic abstraction rather than a complete organic or anatomical form.

It will be appreciated, as noted above, that the geometry or curvature of the package surface at which the organically-shaped feature is to be provided, and even the overall geometry or curvature of the package, also affect the visual impression conveyed by the organically-shaped feature to be provided in accordance with the principles of the present invention. Preferably, the package on which the organically-shaped feature of the present invention is formed in accordance with the principles of the present invention has a soft organic shape, such as a shape with curved surfaces rather than angular surfaces. More preferably, the curved surfaces are gently or softly curved so that sharp transitions (such as transitions at which no tangent line can be drawn) that starkly contrast with the major surface areas are not present (other than in the area of the organically-shaped feature to be provided). Of course, only the region on which the organically-shaped feature is provided may be limited to having such contours. Additionally, or alternatively, the package on which the organically-shaped feature is to be provided preferably has a cross-section that is curved about the longitudinal axis of the package but which does not have a constant radius of curvature (e.g., is not circular). As such, the package on which an organically-shaped feature is formed in accordance with the principles of the present preferably has a non-representational organic form, or at least does not necessarily represent literal proportions of an organic shape (other than the organically-shaped feature to be provided). For example, the package on which the organically-shaped feature is to be provided preferably does not closely follow typical shapes, contours, and proportions of a baby's limb on which a baby fat crease may appear.

It will further be appreciated that typically consumer goods have surface areas provided for product identification. In the case of bottles, often a portion of the surface area of the bottle is dedicated as a label area. To facilitate application of a label on such label area, the label area is curved preferably in only one direction. With reference to the exemplary bottle 100 of FIGS. 1-4, either or both of front and back walls 144, 146 may be formed with a label area 145, 147 curved only in one direction (about a single axis). In the exemplary embodiment of FIGS. 1-4, label area 145, 147 is curved convexly about longitudinal axis L of bottle 100. As may be appreciated with reference to FIG. 4, front and back walls 144, 146 are essentially flat when viewed from the side to facilitate application of a label to the surface of either wall 144, 146. Once such label area is defined, such as label area 145 in front wall 144 (see, in particular, FIGS. 1 and 2) and label area 147 in back wall 146, ends 111, 113 of organically-shaped feature 110 may be defined with respect to such label area. In particular, ends 111, 113 preferably extend to at least the boundary or periphery of such label areas, as may be appreciated with reference to FIG. 4, although a shorter extent may still achieve the desired visual effect of organically-shaped feature 110 as resembling a baby fat crease. It will be appreciated that if either or both ends 111, 113 of organically-shaped feature 110 extend into either or both label areas 145, 147, preferably any label to be applied to such label area 145, 147 can be die-cut to wrap around any creases. It will further be appreciated that the surface of concavely-curved section 136 forming the creased appearance of organically-shaped feature 110 preferably is tangent to the surface of label areas 145, 147 at the point of intersection (at ends 111, 113 of organically-shaped feature 110) to achieve the desired fading effect of the crease described above.

It will be appreciated that a baby fat crease shape formed in accordance with the principles of the present invention may be provided on a bottle or package shaped differently from the exemplary bottle of FIGS. 1-4. For instance, the proportions of the first and second convexly-curved surface sections above and below the baby fat crease shape may be modified from the embodiment of FIGS. 1-4 (such as by having the longitudinal extent of the second convexly-curved section be proportionately longer than the first convexly-curved section than in the embodiment of FIGS. 1-4) while still satisfying the above-described parameters necessary for the crease to have a clear appearance of a baby fat crease. The bottle on which the feature is provided may be asymmetric or have other types of curvatures (e.g., bottle having a concavely-curved wall segment, such as a kidney-shape as in the bottles used on the Buddies™ product line distributed by Johnson & Johnson Consumer Products Company, a Division of Johnson & Johnson Consumer Companies, Inc.).

An organically-shaped feature to be provided on a wall segment of a package in accordance with the principles of the present invention is formed in accordance with the principles of the present invention by satisfying one or more of the above-described parameters to achieve the desired organic look to the feature, particularly to achieve a resemblance to a baby fat crease. Although it is recognized that determination of whether an object appears like or resembles another object is primarily a subjective determination, there nonetheless is a point at which an overwhelming majority (more than 51%, and preferably more than approximately 70%, and most preferably at least approximately 80%) of ordinary observers would recognize or identify a form as resembling another object.

It will be appreciated that the directional references "top," "bottom," "front," and "rear" do not limit the respective panels to such orientation, but merely serve to distinguish these surfaces from one another.

While the foregoing description and drawings represent exemplary embodiments of the present invention, it will be understood that various additions, modifications and substitutions may be made therein without departing from the spirit and scope of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the invention being indicated by the appended claims, and not limited to the foregoing description.

What is claimed is:

1. A bottle comprising:

a top end and a bottom end and a longitudinal axis extending therebetween;

a longitudinal wall section extending between said top end and said bottom end and curving convexly about said longitudinal axis; and no more than two creases in said longitudinal wall section extending transverse to said longitudinal axis;

wherein:

said longitudinal wall section further comprises a first convexly-curved upper section curving convexly at least in part about a first transverse axis transverse to said longitudinal axis, and a second convexly-curved lower section curving convexly at least in part about a second transverse axis transverse to said longitudinal axis;

said first convexly-curved upper section is immediately above and joins and transitions into one of said no more than two creases;

said second convexly-curved upper section is immediately below and joins and transitions into said one of said no more than two creases, said one of said no more than two creases curves convexly around said longitudinal axis and has a concavely-curved surface concavely curving generally at least in part about a third transverse axis transverse to said longitudinal axis; and the difference in the curvature of said first convexly-curved upper section with respect to the curvature of said concavely-curved surface of said one of said no more than two creases, and the difference in the curvature of said second convexly-curved lower section with respect to the curvature of said concavely-curved surface of said one of said no more than two creases are sufficiently large enough that said one of said no more than two creases imparts the appearance of a continuous fold in said convexly-curved wall section rather than a wavy contour, whereby said one of said no more than two creases imparts the appearance of a baby fat crease in said bottle.

2. A bottle as in claim 1, wherein said one of said no more than two creases extends substantially perpendicular to said longitudinal axis of said bottle.

3. A bottle as in claim 1, wherein said one of said no more than two creases extends along a curve rather than a straight line so that said at least one crease does not extend in a direction entirely perpendicular to said longitudinal axis of said bottle.

4. A bottle as in claim 1, wherein:

said first convexly-curved upper section has a first radius of curvature;

said second convexly-curved lower section has a second radius of curvature;

said one of said no more than two creases has a third radius of curvature; and said third radius of curvature is at least 60% smaller than either said first radius of curvature or said second radius of curvature.

5. A bottle as in claim 4, wherein said third radius of curvature is at least 80% smaller than either said first radius of curvature or said second radius of curvature.

6. A bottle as in claim 1, wherein said at least one of said no more than two creases is formed between an inflection in curvature of said first convexly-curved upper section and an inflection in curvature of said second convexly-curved lower section.

7. A bottle as in claim 1, wherein:

said bottle has a height along said longitudinal axis; and said one of said no more than two creases has a radius of curvature not more than approximately 3.5% of said bottle height.

8. A bottle as in claim 7, wherein said radius of curvature of said one of said no more than two creases is not more than approximately 1.5% of said bottle height.

9. A bottle as in claim 8, wherein said radius of curvature of said one of said no more than two creases is not more than approximately 0.5% of said bottle height.

10. A bottle as in claim 1, further comprising at least one label area curving about a single axis and having a periphery, wherein said one of said no more than two creases terminates at a periphery of said label area.

11. A bottle as in claim 1, wherein said one of said no more than two creases gradually decreases in depth and has a gradually increasing radius of curvature to form first and second ends that smoothly transition and fade into surrounding wall surfaces of said bottle immediately laterally adjacent said one of said no more than two creases such that a tangent to said first and second ends of said crease is also tangent to surrounding walls surfaces of said bottle.

12. A bottle as in claim 1, wherein said longitudinal wall section does not have a constant radius of curvature about said longitudinal axis for more than 180 degrees about said longitudinal axis.

13. A bottle as in claim 1, wherein said no more than two creases are the only forms in said longitudinal section deviating from a convexly curved form.

14. A bottle as in claim 1, wherein said one of said no more than two creases is positioned in a middle 7/10 of the height of said bottle along said longitudinal axis.

15. A bottle as in claim 1, wherein:

said longitudinal wall section of said bottle is positioned between a first lateral longitudinally-extending wall section and a second longitudinally-extending wall section;

said longitudinal wall section has a first radius of curvature about said longitudinal axis;

said first lateral longitudinally-extending wall section has a radius of curvature about said longitudinal axis different from said first radius of curvature;

said second lateral longitudinally-extending wall section has a radius of curvature about said longitudinal axis different from said first radius of curvature; and said one of said no more than two creases has a first end at a transition between said longitudinal wall section and said first lateral longitudinally-extending wall section, and a second end at a transition between said longitudinal wall section and said second lateral longitudinally-extending wall section.

16. A bottle as in claim 1, wherein:

said first convexly-curved upper section transitions to said one of said no more than two creases at a first point of inflection; and said second convexly-curved lower section transitions to said one of said no more than two creases at a second point of inflection.

17. A bottle comprising:

a top end and a bottom end and a longitudinal axis extending therebetween;

a longitudinal wall section extending between said top end and said bottom end and curving convexly about said longitudinal axis; and no more than two creases in said longitudinal wall section extending transverse to said longitudinal axis;

wherein:

said longitudinal wall section further comprises a first convexly-curved upper section curving convexly at least in part about a first transverse axis generally transverse to said longitudinal axis, and a second convexly-curved lower section curving convexly at least in part about a second transverse axis generally transverse to said longitudinal axis;

at least one of said no more than two creases curves convexly around said longitudinal axis and has a concavely-curved surface concavely curving at least in part about a third transverse axis generally transverse to said longitudinal axis; and said at least one crease extends along a curve rather than a straight line so that said at least one crease does not extend in a direction entirely perpendicular to said longitudinal axis of said bottle.

18. A bottle comprising:

a top end and a bottom end and a longitudinal axis extending therebetween;

a longitudinal wall section extending between said top end and said bottom end and curving convexly about said longitudinal axis; and no more than two creases in said longitudinal wall section extending transverse to said longitudinal axis;

wherein:

said longitudinal wall section further comprises a first convexly-curved upper section curving convexly at least in part about a first transverse axis transverse to said longitudinal axis and having a first radius of curvature;

said longitudinal wall section further comprises a second convexly-curved lower section curving convexly at least in part about a second transverse axis transverse to said longitudinal axis and having a second radius of curvature;

at least one of said no more than two creases curves convexly around said longitudinal axis and has a concavely-curved surface concavely curving at least in part about a third transverse axis transverse to said longitudinal axis and having a third radius of curvature; and said third radius of curvature is at least 60% smaller than either said first radius of curvature or said second radius of curvature so that said at least one of said no more than two creases imparts the appearance of a continuous fold in said convexly-curved wall section rather than a wavy contour, whereby said at least one of said no more than two creases imparts the appearance of a baby fat crease in said bottle.

19. A bottle as in claim 18, wherein said third radius of curvature is at least 80% smaller than either said first radius of curvature or said second radius of curvature.

20. A bottle comprising:

a top end and a bottom end and a longitudinal axis extending therebetween;

a longitudinal wall section extending between said top end and said bottom end and curving convexly about said longitudinal axis; and no more than two creases in said longitudinal wall section extending transverse to said longitudinal axis;

wherein:

said longitudinal wall section further comprises a first convexly-curved upper section curving convexly at least in part about a first transverse axis generally transverse to said longitudinal axis and immediately above and joining and transitioning into one of said no more than two creases, and a second convexly-curved lower section curving convexly at least in part about a second transverse axis generally transverse to said longitudinal axis and immediately below and joining and transitioning into one of said no more than two creases;

said one of said no more than two creases curves convexly around said longitudinal axis and has a concavely-curved surface concavely curving at least in part about a third transverse axis generally transverse to said longitudinal axis;

the difference in the curvature of said first convexly-curved upper section with respect to the curvature of said concavely-curved surface of said one of said no more than two creases, and the difference in the curvature of said second convexly-curved lower section with respect to the curvature of said concavely-curved surface of said one of said no more than two creases are sufficiently large enough that said one of said no more than two creases imparts the appearance of a continuous fold in said convexly-curved wall section rather than a wavy contour, whereby said one of said no more than two creases imparts the appearance of a baby fat crease in said bottle; and said no more than two creases are the only forms in said longitudinal section deviating from a convexly curved form.

* * * * *